US006776209B1

(12) United States Patent
You

(10) Patent No.: US 6,776,209 B1
(45) Date of Patent: Aug. 17, 2004

(54) ADHESIVE TAPE DISPENSER

(75) Inventor: Kwang Ho You, 103-1102 Hyyndai Apartment, 1037 Mansu-6dong, Namdongku, Inchunshi (KR)

(73) Assignee: Kwang Ho You (KR)

( * ) Notice: Subject to any disclaimer, the term of this patent is extended or adjusted under 35 U.S.C. 154(b) by 0 days.

(21) Appl. No.: 10/386,866

(22) Filed: Mar. 12, 2003

(51) Int. Cl.[7] ..... B32B 31/00

(52) U.S. Cl. ..... 156/577; 156/523; 156/579; 118/76; 118/257; 242/160.4; 242/171; 242/588.6

(58) Field of Search ..... 156/577, 574, 156/579, 523, 527, 540, 238; 118/76, 200, 257; 242/160.2, 170, 160.4, 171, 588.2, 588, 588.3, 588.6

(56) References Cited

U.S. PATENT DOCUMENTS 6,273,169 B1 * 8/2001 Ono et al. ..... 156/540

6,681,827 B2 * 1/2004 Tamai et al. ..... 156/577

* cited by examiner

*Primary Examiner*—Richard Crispino
*Assistant Examiner*—Cheryl N. Hawkins
(74) *Attorney, Agent, or Firm*—Anderson Kill & Olick; Eugene Lieberstein; Michael N. Meller

(57) ABSTRACT

The present invention relates to an adhesive tape dispenser which receives an adhesive tape coated with coating substance such as bonding substance in order to stick the same to a surface of a sheet. The adhesive tape dispenser includes a guide tip pivotally mounted on a leading end of a tape-supporting frame in such a manner as to be rotated at a predetermined angle so that a tape can be easily used and coating substance of the tape can adhere well to a wide area of the sheet surface while maintaining a proper degree of elasticity.

5 Claims, 3 Drawing Sheets

ADHESIVE TAPE DISPENSER

BACKGROUND OF THE INVENTION

1. Field of the Invention

The present invention relates to an adhesive tape dispenser, and particularly to an adhesive tape dispenser which includes a guide tip pivotally mounted on a leading end of a tape-supporting frame in such a manner as to be rotated at a predetermined angle so that a tape can be easily used and coating substance of the tape can adhere well to a surface of a sheet while maintaining a proper degree of elasticity.

2. Description of the Related Art

Adhesive, such as paste or glue, is generally used to seal an envelope. In particular, adhesive is generally contained in a coating container in order to enhance convenience and easiness in use. However, adhesive has a disadvantage in that it takes a long drying time. Because of that, an adhesive tape dispenser is preferably used, which uses bonding substance which may not take a long drying time.

The adhesive tape dispenser receives a roll of a tape coated with bonding substance within a housing, and is structured such that bonding substance adheres to a surface of a sheet through an inlet formed at a portion of the housing after a series of routes. The bonding substance passes through a projected guide which assists the bonding substance to adhere to the sheet surface. However, the guide for sticking the bonding substance to the sheet surface has more or less drawbacks in its structure. As a result, the bonding substance does not clearly adheres to the sheet surface, and in particular, the tape is re-wound around the tape roll with a certain amount of bonding substance remaining therein, thereby wasting raw materials.

SUMMARY OF THE INVENTION

The present invention has been made to solve the foregoing problems and it is therefore an object of the present invention to provide an adhesive tape dispenser which includes a guide tip pivotally mounted on a leading end of a tape-supporting frame thereinside in such a manner as to be rotated at a predetermined angle, so that coating substance of a tape very efficiently adheres to a wide area on a sheet surface while maintaining a certain degree of elasticity.

According to an aspect of the invention to obtain the above objects, an adhesive tape dispenser comprises: a pair of detachably coupled housings for receiving a roll of tape coated with coating substance; a tape inlet formed at one end of the housings through which coating substance adheres to a surface of an object; a tape-supporting frame detachably coupled within the housings for rotatably supporting the tape roll, and having a leading end projected out of the tape inlet for guiding the tape drawn from the tape roll; a coupling hole formed in the leading end of the tape-supporting frame in such a manner as to be outwardly opened along a longitudinal direction of the leading end; and a guide tip including a coupling shaft pivotally coupled to the inside of the coupling hole, a guide rod bidirectionally extended from one end of the coupling shaft at a substantially right angle to press coating substance of the tape against the surface of the object when the tape is drawn out of the tape roll and protrusions upwardly projected from both ends of the guide rod to prevent escape of the tape.

It is preferred that the coupling hole has a groove and the coupling shaft of the guide tip has a projection-shaped stopper projected therefrom in a longitudinal direction thereof for being coupled to the groove so that pivotal motion of the guide tip is made within the lateral extent of the groove in the coupling hole.

It is also preferred that the coupling shaft of the guide tip has an annular coupling groove formed along the outer peripheral surface thereof and the coupling hole has an annular coupling projection formed along the inner peripheral surface thereof corresponding to the outer peripheral surface of the coupling shaft so that the coupling groove and the coupling projection are coupled to each other to enhance a coupling force when the guide tip is inserted into the coupling hole.

Preferably, the annular coupling groove is formed at a position where the projection of the stopper in the coupling shaft is ended.

It is also preferred that the tape-supporting frame further has guide members formed at both sides of the leading end thereof for guiding the tape toward the guide tip.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE PREFERRED EMBODIMENT

The following detailed description will present a preferred embodiment of the invention in reference to the accompanying drawings.

Figure 1:
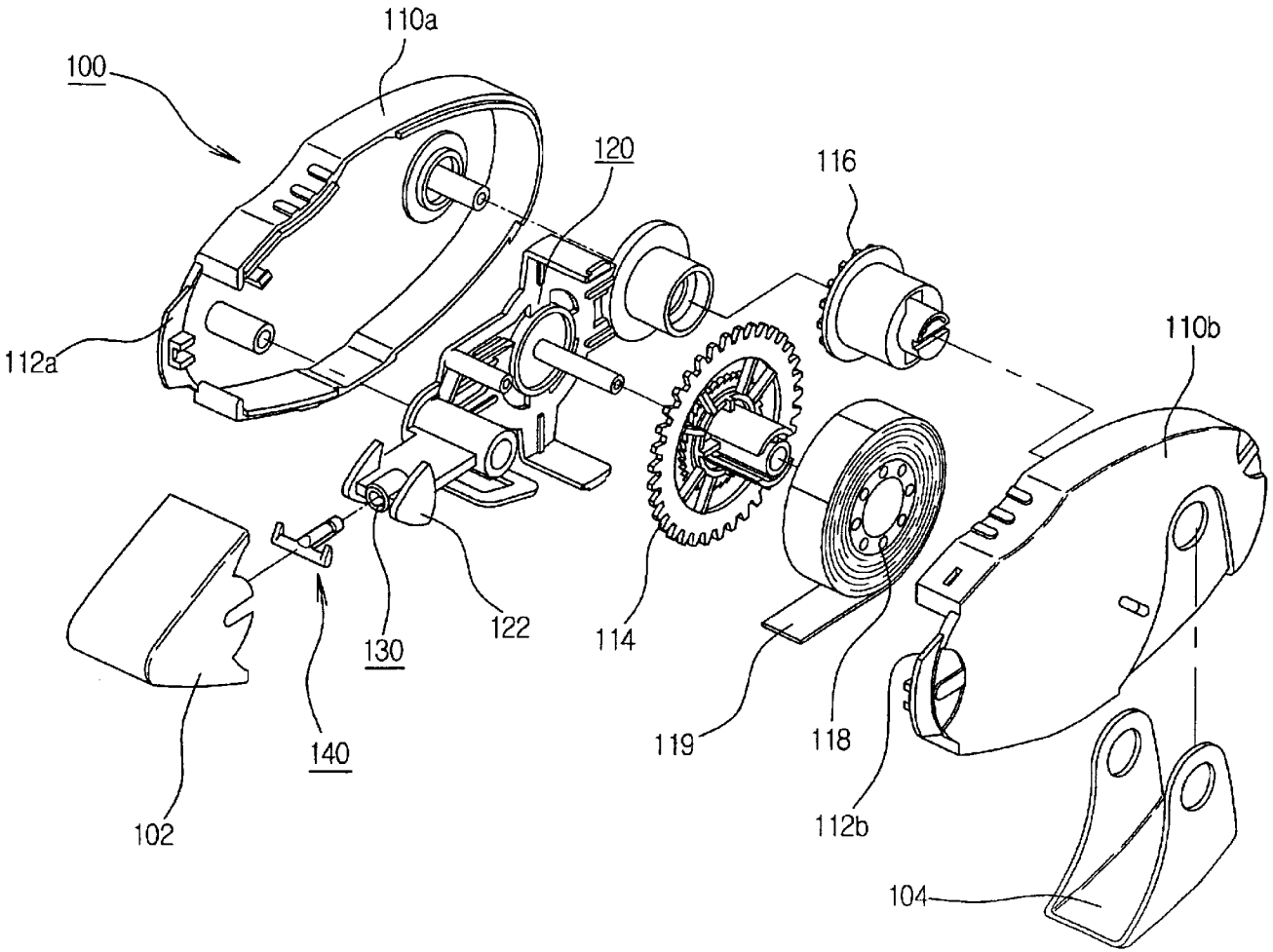
FIG. 1 is an exploded perspective view of an adhesive tape dispenser according to the invention.

FIG. 1 is an exploded perspective view of an adhesive tape dispenser of the invention.

As shown in FIG. 1, an adhesive tape dispenser 100 of the invention comprises a pair of housings 110*a* and 110*b*which are detachably coupled to each other. A tape-supporting frame 120 is detachably coupled in the casings 110*a* and 110*b* in such a manner as to be adjacent to the housing 110*a*. The tape-supporting frame 120 rotatably supports at least two gears 114 and 116 which are meshed with each other.

An adhesive tape roll 118 is coupled to one side of the first gear 114 so that the adhesive roll 118 rotates along with the first gear 114. One end of an adhesive tape 119 is drawn from the adhesive tape roll 118, passed through adhesive tape inlets 112*a* and 112*b* disposed at front ends of the housings 110*a* and 110*b*, and fixed to the second gear 116.

The adhesive tape 119 includes a film and tacky adhesive substance or correction substance (hereinafter referred to as "coating substance") which is coated on one side of the film. Coating substance of the adhesive tape 119 adheres to a sheet or an object to be coated, and the left film is continuously wound around the second gear 116 which is rotated in cooperation with the first gear 114. In this manner, the film can be easily recovered.

Reference numeral 102 designates a protective cap, which is covered on the inlets 112*a* and 112*b* to prevent coating substance from getting dry when the coating substance is exposed while passing the inlets 112*a* and 112*b*. The reference number 104 designates a fixture, which is externally coupled with the housings 110*a* and 110*b* to prevent detachment of the housings 110*a* and 110*b* when they are coupled to each other.

A guide tip 140 is pivotally mounted on a leading end of the tape-supporting frame 120, which is a characteristic part of the invention. A configuration of the guide tip 140 is shown in FIGS. 2 to 5.

Figure 2:
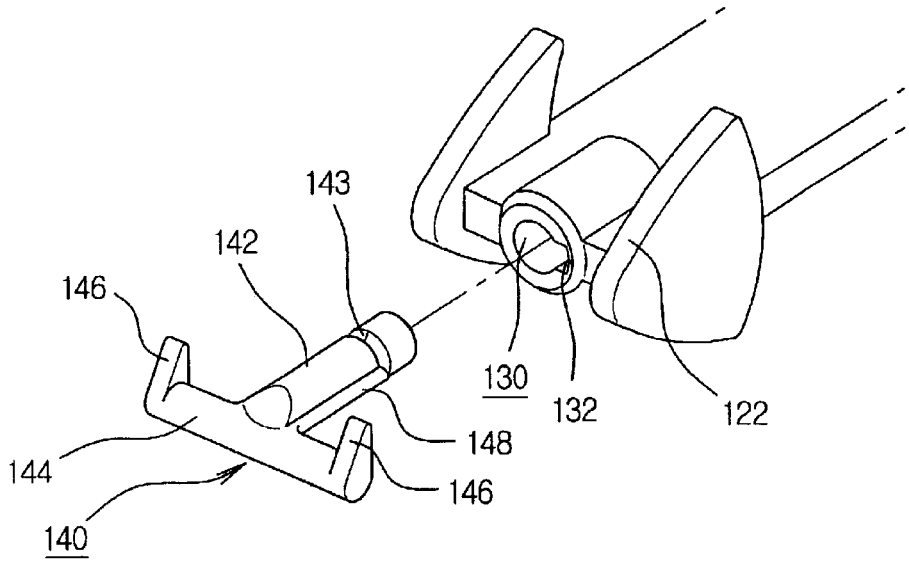
FIG. 2 is an exploded perspective view of a guide tip in the adhesive tape dispenser according to the invention.
Figure 3:
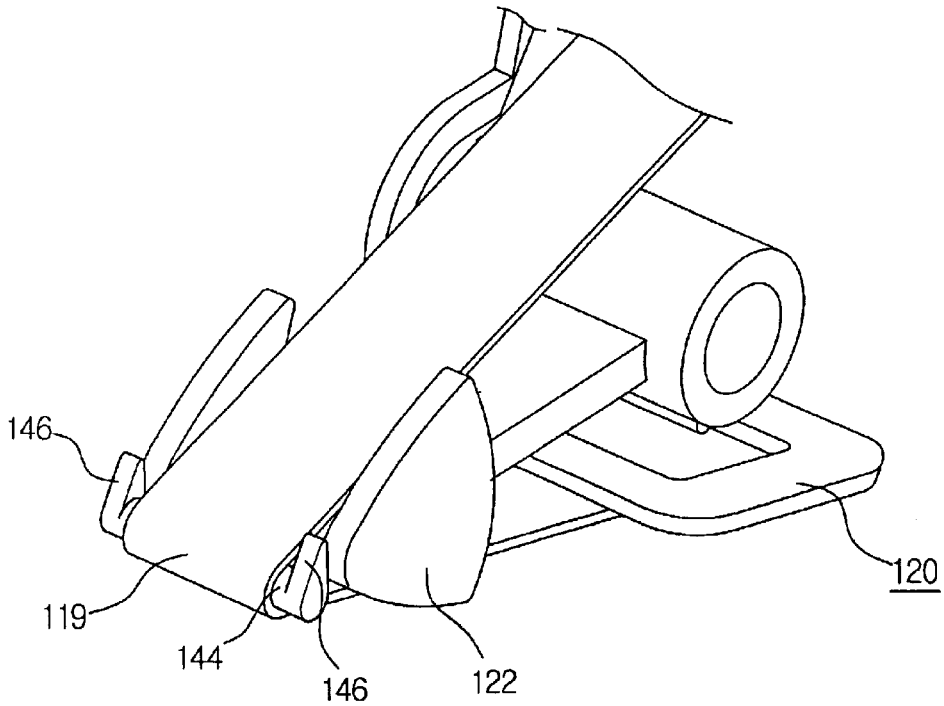
FIG. 3 is a perspective view illustrating a state in which the guide tip guides a tape in the adhesive tape dispenser according to the invention.
Figure 4:
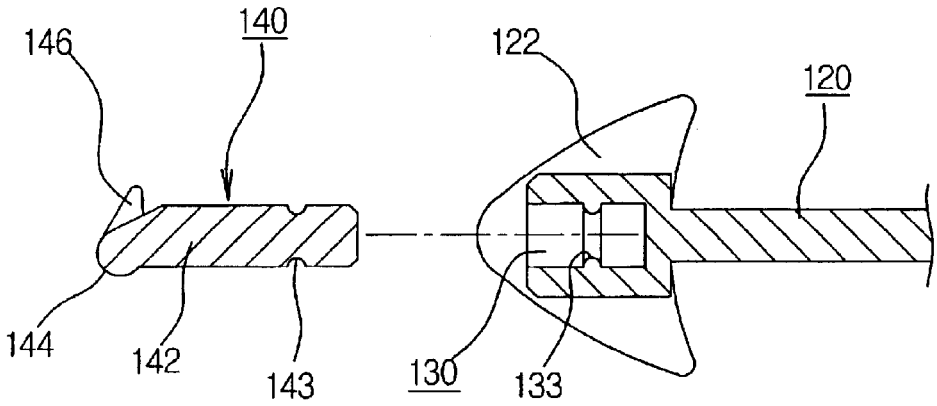
FIG. 4 is a sectional view of the guide tip in the adhesive tape dispenser, illustrating a state in which the guide tip is separated from a tape-supporting frame according to the invention.
Figure 5:
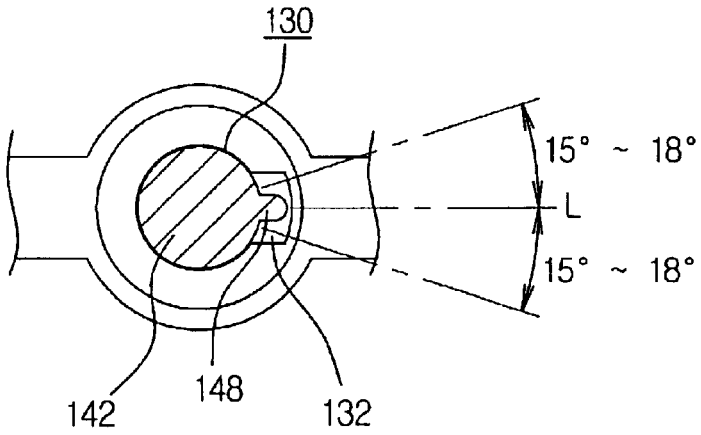
FIG. 5 is a sectional view for explaining pivoting motion of the guide tip in the adhesive tape dispenser according to the invention.

FIG. 2 is an exploded perspective view of the guide tip in the adhesive tape dispenser according to the invention, FIG. 3 is a perspective view illustrating a state in which the guide tip guides a tape in the adhesive tape dispenser according to the invention, FIG. 4 is a sectional view of the guide tip in the adhesive tape dispenser, illustrating a state in which the guide tip is separated from the tape-supporting frame according to the invention, and FIG. 5 is a sectional view for explaining pivoting motion of the guide tip in the adhesive tape dispenser according to the invention.

As shown in drawings, a coupling hole 130 is formed in the leading end 120 of the tape-supporting frame 120, in such a manner as to be outwardly opened along a longitudinal direction of the leading end. The guide tip 140 is pivotally coupled to the coupling hole 130 so that the coating substance adheres to a surface of a sheet or an object to be coated. Also, guide members 122 for guiding the tape 119 are preferably mounted at both sides of the tape-supporting frame 120.

The guide tip 140 includes a coupling shaft 142 pivotally coupled to the inside of the coupling hole 130, a guide rod 144 bidirectionally extended from one end of the coupling shaft 142 at a substantially right angle to press the coating substance of the tape 119 against the sheet surface when the tape 119 is drawn out of the tape roll 118 and protrusions 146 upwardly projected from both ends of the guide rod 114 to prevent escape of the tape 119.

The guide tip 140 also has a projection-shaped stopper 148 projected from the coupling shaft 142 along a longitudinal direction of the coupling shaft 142. The coupling hole 130 has a groove 132 formed thereon so that the stopper 148 of the guide tip 140 is rotated in the groove 132 of the coupling hole 130 within the lateral extent of the groove 132.

The pivoting motion of the guide tip 140 within the groove 132 is shown in FIG. 5.

Referring to FIG. 5, the stopper 148 positioned in the groove 132 of the coupling hole 130 pivots within the lateral extent of the groove when the guide tip 140 pivots. Most preferably, the guide tip 140 pivots at an angle of about 15 to 18 deg. upward from the central line L and also about 15 to 18 deg. downward from the central line L. That is, the guide tip 140 preferably pivots in a range of about 30 to 38 deg.

An annular coupling groove 143 is formed along the outer peripheral surface of the coupling shaft 142 of the guide tip 140, and an annular coupling projection 133 is formed along the inner peripheral surface of the coupling hole 130 corresponding to the outer peripheral surface of the coupling shaft 142. The coupling groove and projection 143 and 133 are coupled to each other to enhance the coupling force between the guide tip 140 and the coupling hole 130 when the guide tip 140 is inserted into the coupling hole 130. The annular coupling groove 143 is formed at a position where the projection of the stopper 148 in the coupling shaft 142 is ended.

The guide tip 140 pivots at the predetermined angle as above so that the adhesive tape dispenser is conveniently used for sticking the coating substance on the sheet surface. Hereinafter the operation of the adhesive tape dispenser will be described.

First, the guide tip 140 is pressed under a proper amount of force against the sheet surface to stick the coating substance to the sheet surface. The pressing force causes the guide tip 140 to pivot at the predetermined angle, thereby applying a certain amount of tension to the guide tip 140. As a consequence, the coating substance easily adheres to the sheet surface.

As the guide tip 14 pivots at the predetermined angle, the tape 119 guided by the guide tip 140 is twisted, creating a slight amount of tension. Thus, the tape 119 is readily drawn out and the coating substance efficiently adheres to the sheet surface.

Pivoting the guide tip 140 liberates a user from paying attention to a hand position for holding the adhesive tape dispenser 100 when he/she uses the adhesive tape dispenser 100. Therefore, even if the adhesive tape dispenser 100 is held in any direction, he or she can use the adhesive tape dispenser 100 more conveniently since the guide tip 140 rotates.

Since the guide tip 140 is coupled to the coupling hole 130 in the leading end of the tape-supporting frame 120, the adhesive tape dispenser 100 of the invention is simply assembled as well as readily refilled. As a result, the invention can reduce the manufacturing cost of the adhesive tape dispenser.

The protrusions 146 formed in the guide tip 140 help the tape 119 to be efficiently guided. That is, when the tape 119 is pressed to stick coating substance to the sheet surface, the protrusions 146 support both lateral portions of the tape to prevent shaking of the tape 119.

The guide tip 140 pivots at the predetermined angle to expand the adhering area of coating substance so that the coating substance can adhere to the object without restriction in position so as to enhance adhering efficiency.

Where the guide tip is mounted on a tape guide member equivalently as above in various adhesive tape dispensers having the same purpose as the above embodiment so that the guide tip pivoting at the predetermined angle assists coating substance to adhere well to the sheet surface, it is also construed that those adhesive tape dispensers belong to the scope of the invention even though they have different structures from the adhesive tape dispenser of the above embodiment.

According to the invention as set forth above, the adhesive tape dispenser comprises the guide tip pivotally mounted on the leading end of the tape-supporting frame inside the adhesive tape dispenser in such a manner as to be rotated at the predetermined angle, so that coating substance of a tape very efficiently adheres to a wide area on a sheet surface while maintaining a certain degree of elasticity.

What is claimed is:

1. An adhesive tape dispenser comprising:

a pair of detachably coupled housings for receiving a roll of tape coated with coating substance;

a tape inlet formed at one end of the housings through which coating substance adheres to a surface of an object;

a tape-supporting frame detachably coupled within the housings for rotatably supporting the tape roll, and having a leading end projected out of the tape inlet for guiding the tape drawn from the tape roll;

a coupling hole formed in the leading end of the tape-supporting frame in such a manner as to be outwardly opened along a longitudinal direction of the leading end; and a guide tip including a coupling shaft pivotally coupled to the inside of the coupling hole, a guide rod bidirectionally extended from one end of the coupling shaft at a substantially right angle to press coating substance of the tape against the surface of the object when the tape is drawn out of the tape roll and protrusions upwardly projected from both ends of the guide rod to prevent escape of the tape.

2. The adhesive tape dispenser as set forth in claim 1, wherein the coupling hole has a groove and the coupling shaft of the guide tip has a projection-shaped stopper projected therefrom in a longitudinal direction thereof for being coupled to the groove so that pivotal motion of the guide tip is made within the lateral extent of the groove in the coupling hole.

3. The adhesive tape dispenser as set forth in claim 1, wherein the coupling shaft of the guide tip has an annular coupling groove formed along the outer peripheral surface thereof and the coupling hole has an annular coupling projection formed along the inner peripheral surface thereof corresponding to the outer peripheral surface of the coupling shaft so that the coupling groove and the coupling projection are coupled to each other to enhance a coupling force when the guide tip is inserted into the coupling hole.

4. The adhesive tape dispenser as set forth in claim 3, wherein the annular coupling groove is formed at a position where the projection of the stopper in the coupling shaft is ended.

5. The adhesive tape dispenser as set forth in claim 1, wherein the tape-supporting frame further has guide members formed at both sides of the leading end thereof for guiding the tape toward the guide tip.

* * * * *